US007396171B2

(12) United States Patent
Gipson

(10) Patent No.: US 7,396,171 B2
(45) Date of Patent: Jul. 8, 2008

(54) THOR EXPANDABLE RING PRINTER FOR WIDE PRINT MEDIA

(76) Inventor: Dwain Gipson, 1651 Whitewood Ct., Corona, CA (US) 92882

( * ) Notice: Subject to any disclaimer, the term of this patent is extended or adjusted under 35 U.S.C. 154(b) by 547 days.

(21) Appl. No.: 11/224,883

(22) Filed: Sep. 12, 2005

(65) Prior Publication Data

US 2007/0065210 A1 Mar. 22, 2007

(51) Int. Cl.
*B41J 9/00* (2006.01)
*B41J 9/38* (2006.01)

(52) U.S. Cl. ..... 400/139; 400/140; 400/142; 101/83; 101/93.1; 101/93.43

(58) Field of Classification Search ..... 400/124.1, 400/162, 163.1–164, 139, 140, 142, 153, 400/154, 155, 155.1, 156, 157, 157.1, 157.2; 101/83–89, 93.1, 93.15–93.18, 93.23–93.34, 101/93.42, 93.43, 93.48–110
See application file for complete search history.

(56) References Cited

U.S. PATENT DOCUMENTS 4,297,944 A * 11/1981 Nihira ..... 101/93.31
4,553,870 A * 11/1985 Takenoya et al. ..... 400/662
4,655,130 A * 4/1987 Kyogoku et al. ..... 101/93.23
4,683,819 A * 8/1987 Mikoshiba ..... 101/93.22
5,760,817 A 6/1998 Foote et al.
5,801,744 A 9/1998 Taniguchi et al.
5,906,157 A * 5/1999 Mazumder ..... 101/93.48
6,109,715 A 8/2000 Masaki
6,561,707 B2 * 5/2003 Garramone et al. ..... 400/124.1
6,651,560 B2 * 11/2003 Neuhaus ..... 101/401.1

* cited by examiner

*Primary Examiner*—Daniel J. Colilla
*Assistant Examiner*—'Wynn' Q Ha
(74) *Attorney, Agent, or Firm*—Kirk A. Buhler; Buhler & Associates

(57) ABSTRACT

A printing machine for use with paper roll stock is disclosed. The print head consists of an expandable cylindrical ring print head where the printing brushes are integrated in a spiral pattern around the ring print head. Ink wells are located outside of the print head, and electromagnets, located outside of the ring print head, attract or repel the print brushes towards or away from the ink wells or paper. The printing machine is ideally suited for advertising or other elongated print media. Due to the use of standard paper roll stock and speed of the printing, signs can be printed on demand and displayed in a real-time basis. Two printing machines can be configured to print on both sides of the paper at the same time with the same or different images being printed on each side.

20 Claims, 6 Drawing Sheets

THOR EXPANDABLE RING PRINTER FOR WIDE PRINT MEDIA

FIELD OF THE INVENTION

This invention relates to a printer that prints on media such as paper, vinyl, cloth, plastic, or other flexible media that can be printed upon. More particularly, the present invention relates to a cylindrical print head with multiple printing pins, hammers or brushes that collect black or colored ink and then print the ink onto paper stock. The configuration of the cylindrical print head allows the head to be expanded for printing on wider paper stock. The print brushes are brought into contact with the inkwells and paper by magnetic attraction. The reverse magnet force can push the print brushes away from the paper and inkwells to prevent marking on the paper.

BACKGROUND OF THE INVENTION

Printers or printing machined today are available in a variety of configurations. The most common printers today utilize ink jet technology where ink is sprayed onto paper from a print head. Most printers that use this technology hold the paper in a fixed position and move the head side to side to spray dots of colored ink onto a paper. An exemplary example of this type of technology can be found in U.S. Pat. No. 6,109,715 issued to Masaki on Aug. 29, 2000. While this method of printing allows for printing on paper, it is limited to the preset width of the printer, and in most cases prints on just one page at a time. These printers are not expandable and cannot print fast enough to print a banner that can be viewed as a moving sign.

Another variety of printer is an impact printer. The impact printer prints with hammers, pins, or characters that strike a ribbon of ink to imprint the image onto the paper. These printers print either a complete horizontal line, vertical line or individual character using a daisy wheel. These printing methods the paper or print head is moved, and ink is applied through a ribbon coated with ink. An exemplary example of this type of technology can be found in U.S. Pat. No. 4,553,870 issued to Takenoya et al on Nov. 19, 1985. While this printer is capable of impact printing color onto paper, the print head move across the page in this configuration and the ink cartridge moves with the print head. This configuration is limited to the finite size of the printer arrangement to determine the size of the paper that can be printed upon, and does not allow for expansion of the paper width.

Another variety of printer is a thermal printer that uses special paper that is sensitive to heat. When an area of the paper is heating with a print head, the area turns dark. A patent that shows this type of printing technology can be found in U.S. Pat. No. 5,801,744 issued Sep. 1, 1998 to Taniguchi et al. This printer is capable of thermal printing onto paper, but the print head moves across the page in this configuration. It also requires special paper that may not be available in wide rolls. This configuration is limited to the finite size of the printer arrangement to determine the size of the paper that can be printed upon and does not allow for expansion of the print width.

Another variety of printer is a laser printer that uses a laser or similar method to electrostatically charge particles of ink that are placed on the drum. As paper is brought in contact with the drum, the particles of ink are transferred to the paper and baked onto the paper. U.S. Pat. No. 5,760,817 issued to Foote et al. on Jun. 2, 1998 describe this type of printing method. This printer can use standard paper, but requires sophisticated technology that is sensitive to damage. The laser printer further is not expandable to print on wider media.

Traditional printing methods involve screening the image onto the paper or pressing the image onto the paper with a printing press. This type of printing method is most commonly used to print in large volumes of the same image. While these printing methods allow for a large amount of printing to be performed in a short period of time, it does not allow for quick and easy changing of what is printed, and may be limited to the finite length of printing.

What is needed is a simple to expand printer that can operate at a high print rate and can print on continuous sheets of paper. The ideal printer would use a cylindrical print head with drivers located outside of the cylindrical print head to collect and deposit ink onto a roll of paper. The ideal printer would also be able to print on both sides of the paper simultaneously as the paper is being fed through the printer. The proposed device satisfies these needs.

BRIEF SUMMARY OF THE INVENTION

It is an object of the present Thor printer is to provide an expandable printer for use with roll paper stock. The expansion capability allows for the printing heads, ink wells and platen to be stackable. The units may be fabricated in standard 8.5" lengths or may be made in 12" lengths. In order to accommodate 36" wide paper three sets of 12" long units can be stacked. If at some point in the future 48" or 60 inch wide paper is used, additional units can be added to the existing printer to print on the wider paper.

It is another object of the invention to provide a printer with marking heads spaced monotonically in an X-Y pattern around a ring or cylinder. When the cylindrical marking head is rotated and the marking heads print onto the print media passed under the marking heads, the visual interpretation of this arrangement produces an image. This image can represent textual and or graphical data.

It is another object of the Thor printer to allow the printer to print on both sides of the paper at the same time. This can be done by placing printers on each side of the paper and connecting them through one or two controllers.

It is another object of the Thor printer to provide printing in black or black and colors. The printer can be changed from one to multiple colors by simply adding additional ink wells to the printer. Because the ink wells are a configurable part of the printer they can be easily added, changed or upgraded based upon the requirements of the end user.

It is a further objective of the Thor printer to provide a cost effective continuous printing method that can print long sheets of roll stock for advertising at businesses, sporting events or other locations that may want to promote or advertise. The advantage of this type of advertising message signs is that once the printer has printed the printer turns off and no additional power is used to display the information. The printed sign will display the message without consuming any additional power.

It is yet another object of the Thor printer to allow operation with a standard computer interface such as a serial, USB, internet, firewire, RS232, ethernet or parallel printer port. The computer can be connected to the printer, the sign printed, and the computer disconnected leaving the sign being shown. Because of the cost effective nature of the printer and the operation of the printer, a different sign or advertisement can be printed and displayed every day, or printed on a continuous basis to appear as a scrolling message sign. The interface allows for printing of both text and or graphics as communicated from an attached computer. Internal memory can be included with the printer to allow the printer to automatically turn on at predetermined time or interval, print a sign and turn off again until the next interval.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
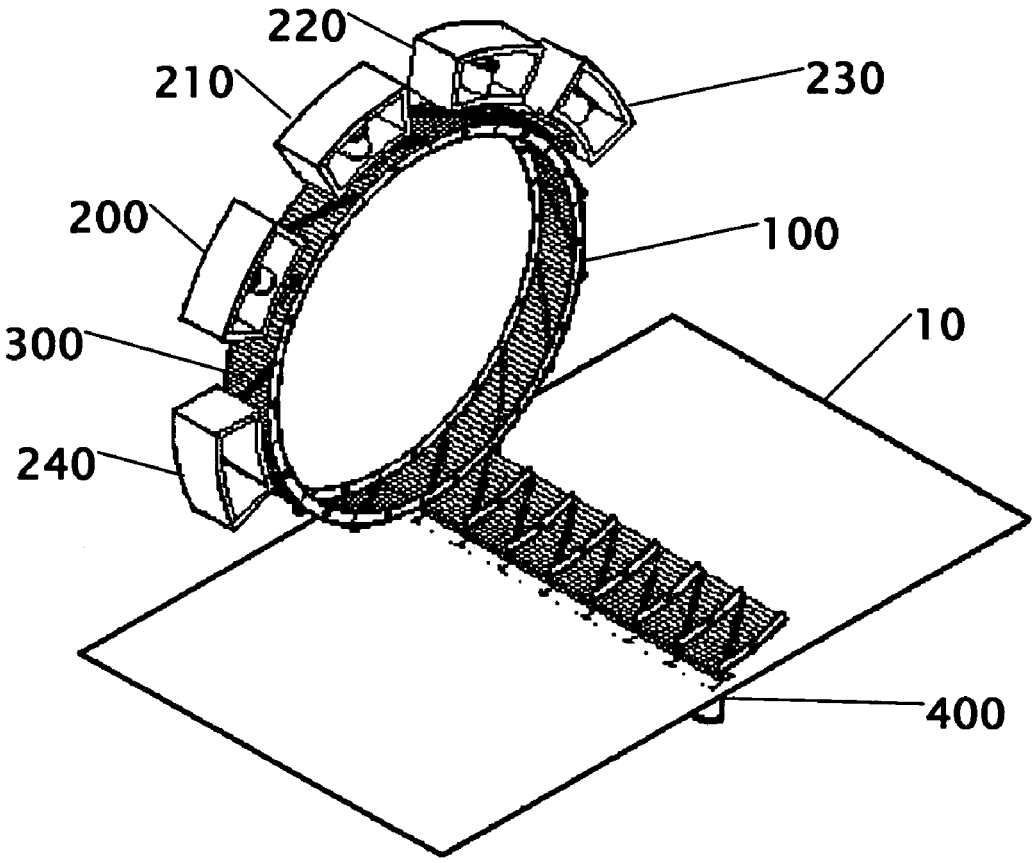
FIG. 1 shows an isometric view of the Thor printer in a cut-away view showing the components.

Referring to FIG. 1 showing an isometric view of the Thor printer in a cut-away view showing the components. In this figure, the marking roller is shown with only one ring 100. Black inking station 200, blotting three color mixing stations 210, 220, 230 are shown spaced around the ring. An ink blotting station 240 is also shown. The platen assembly is shown with paper media 10 passing between the printing roller and the platen 400. While the media is shown and described as paper, the media can include but not be limited to paper, vinyl, cloth, plastic, or other flexible, rigid or semi-rigid substrate. This comprises the basic structure of the design where each of the components will be described in more detail. In general operation of the Thor printer, the marking roller is rotated and as the marking heads 300 are rotate past the inking stations, items 200, 210, 220 and 230, ink is applied to the marking heads. The roller rotates around until it is over the print media, and then ink on the marking head is pressed onto the media to deposit the ink. The roller will then rotate the marking head around and any excess ink will be blotted off 240. Multiple marking heads are placed on the roller marking ring in an orientation that provides marking for only one head at a time.

The ink station is mounted at a point along the circumference in the same way as the marking platen. In the case of a monochromatic marking system, there is only one inking station. In the case of a multi-chromatic marking system (as shown) there is several ink stations spaced along the circumference. The marking segments are connected end-to-end to form a circular ring. In this case, there are 14 segments that make the ring. The marking platen is mounted tangent to the ring circumference. As the ring is spun about its center, the marking brushes mounted to the segments, scan the marking platen in a regular pattern. In this case, there are 14 brushes spaced along 15 uniform spaces along each segment. For each segment that passes the marking platen, there are 14 brushes and one space.

In the preferred embodiment, the marking roller 100 is constructed in 8-inch wide sections that can be connectively joined to allow printing on media 10 with different widths. As an example if the media is 48" wide paper, then eleven 8-inch sections can be used to print across the entire 48" wide paper. It is only for use of simplicity of describing the construction of the apparatus a single 8-inch is shown and described, but the actual width of the roller can be made to virtually any width. It is contemplated that the printer rings can be stacked for a billboard that is 12 feet tall. FIG. 1 show only a single section of the marking roller, a complete marking roller can be seen in FIG. 3 where it will be described in more detail.

Figure 2:
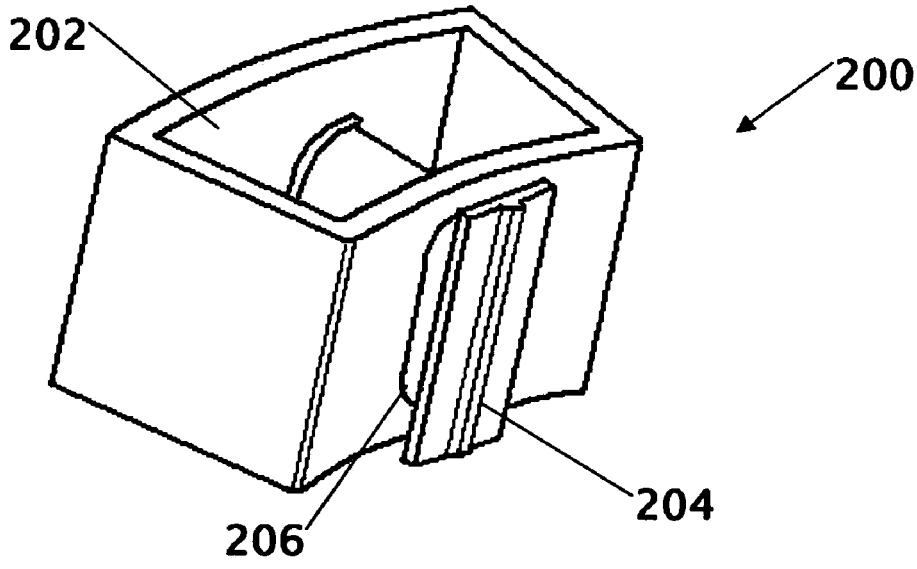
FIG. 2 shows an isometric view of an ink blotting station.

The ink blotting and ink stations have a similar construction but perform different functions. The function of the inking station is to apply ink to each marking head, while the function of the ink blotting station is to remove any remaining ink from the marking head before new ink is applied to the marking head. FIG. 2 shows an isometric view of an ink blotting station. Using just the black ink well as an example, the ink station 200 consists of a well or reservoir for ink 202 where the color, pigment is retained. The ink marking station is made from a polymer and neodymium compound. The platen 204 has a charging coil 206 wound onto it. The charging coil creates an electromagnetic force that can either attract or repel a marking head. A more detailed description of the charging coil is described with FIGS. 7 and 8. The shape of the platen and reservoir allows the ink to flow onto a platen surface. The inking is located at a point around the roller such that it is essentially parallel to the circumference of the marking roller. As a marking brush passes by the inked platen surface, if the brush is electro-magnetically attracted to the inked surface, it will be held to and slid across the inked surface. This will result in the ink being deposited onto the marking brush. Conversely, if the marking brush is electro-magnetically repelled, there will be no ink deposited on the marking brush.

Residual ink can remain on the marking brush, and if the ink is not removed, it will result in an undesirable mixing of the ink colors. A cleaning ink removal or blotting station, item 240 from FIG. 1 that is similar to the inking stations provides a solvent and a place to "wipe-off" any residue.

Figure 3:
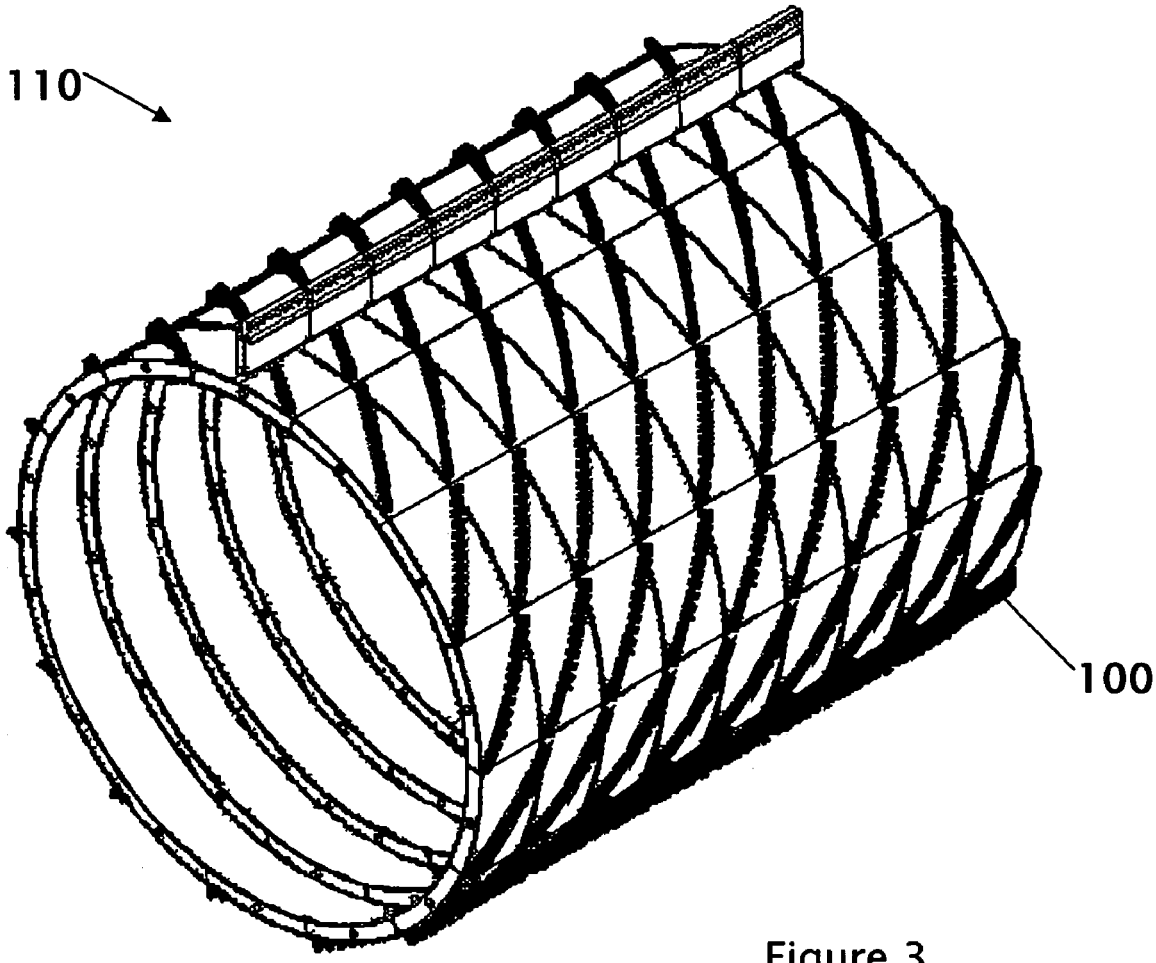
FIG. 3 is a side view of an 8-inch section of the roller with an electro-magnetic platen.

FIG. 3 is a side view of an 8-inch section of the roller with an electro-magnetic platen. Comparing FIG. 1 to this FIG. 3, multiple one-inch ring sections 100 are connected together to form this 8-inch printing roller 110. Multiple platens, each with separate electro-magnetic coils are shown to control the marking heads.

Figure 4:
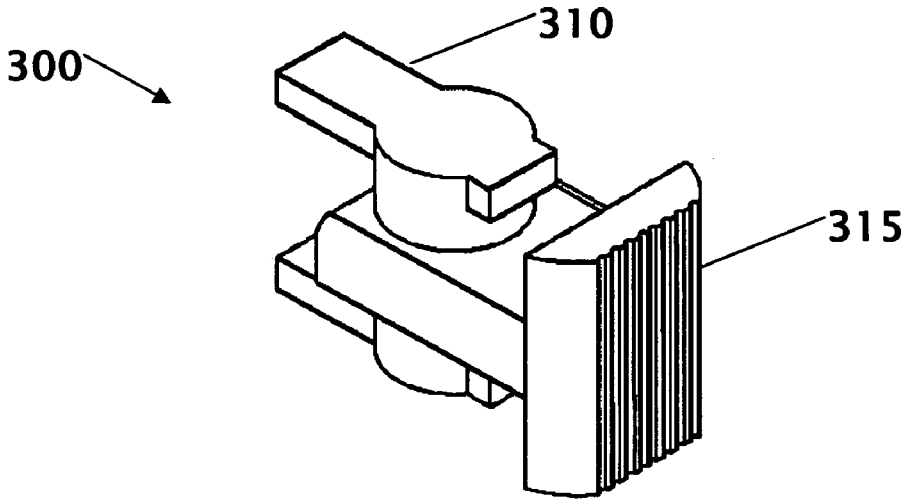
FIG. 4 is a detailed isometric view of a marking head.

FIG. 4 is a detailed isometric view of a marking head or marking brush. The marking brush 300 is a unique shaped structure molded using a compound of plastic polymer and neodymium powder. The plastic polymer serves as a bonding agent for the neodymium power. The power is evenly dispersed throughout the structure. The neodymium powder is magnetically chargeable. By magnetically charging the structure along its longitude, its magnetic attraction-repulsion property can be exploited. The marking surface is charged magnetically "North". The marking brush marking surface has grooves to retain the ink until it is transferred to the media during the marking process. A pivot mounting guide 310 allows the print head to slide within the brush holding yokes shown in FIG. 4. The pivot mounting guide 310 allows the marking surface 315 to pivot slightly as it makes contact with the inking, platen to mark the media and the blotting station.

Figure 5:
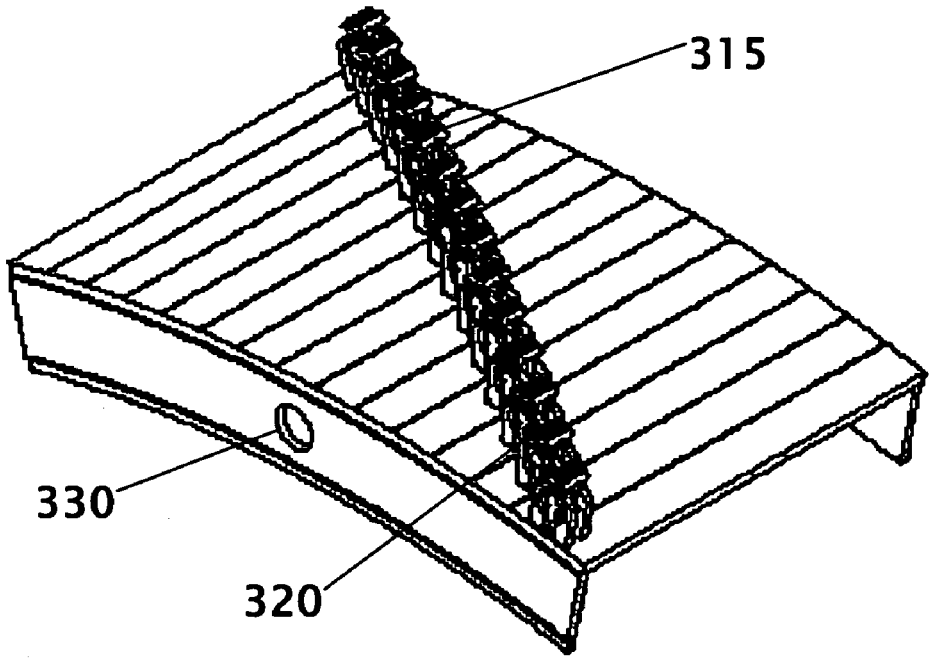
FIG. 5 shows an isometric view of a section of mounting yoke with the marking heads installed.

FIG. 5 shows an isometric view of a section of mounting yoke with the marking heads 315 installed. The marking brush (from FIG. 4) is mounted into yokes 320 that are part of the brush mount. The yoke is specifically designed to allow the marking brush to pivot during the marking process and be precisely aligned during the non-marking process. The section shown in this figure is a segment of the marking roller or ring shown in FIGS. 1 and 3. The brush mount is a unique molded polymer structure. It is molded generally in the shape of an arc segment. When connected from end-to-end, the segments form a complete ring assembly. There is a locating post on the side edge of each brush mount and a corresponding hole 330 on the opposite side. The purpose of the locating post and holes is to provide for radial registration for adjacent side mounted ring assemblies. Along the circumference surface of the mount there are several brush mounting yokes. The yokes are equally offset spaced laterally along the arc center and equally offset spaced radially along the arc circumference surface.

Figure 6:
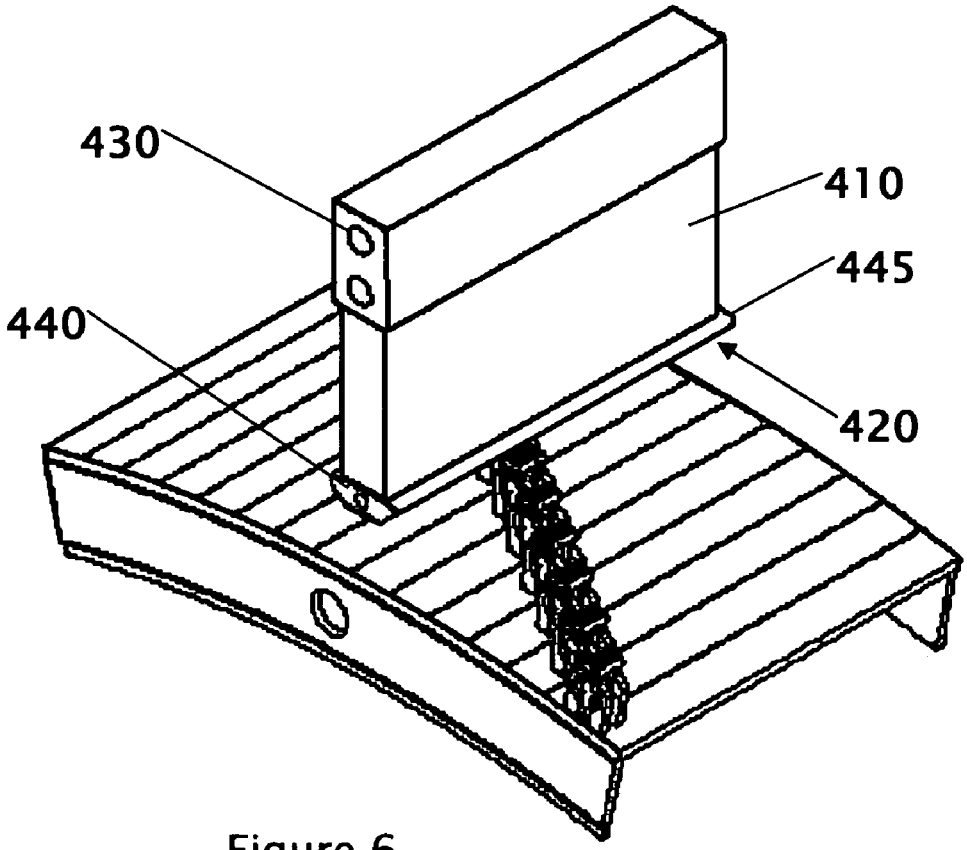
FIG. 6 is an isometric view of an electromagnetic platen over a section of the marking head without the coil wrapped around the platen component.

FIG. 6 is an isometric view of an electromagnetic platen component without the coil wrapped around the platen. In order to make marks on the media, the marking brush has to press against its front surface 420. Since the media is very pliable, something is required to keep it stationary during the marking process. The ink is transferred to the media due to the pressure exerted when the media is pressed between the marking brush and the marking platen. In the preferred embodiment, the platen is a molded structure. The platen is molded using a compound of plastic and neodymium powder. The plastic polymer serves as a bonding agent for the neodymium power. The power is evenly dispersed throughout the structure. The neodymium powder is magnetically chargeable. By magnetically charging the structure along its longitude, its magnetic attraction-repulsion property can be exploited. The face of marking platen is intermittently charged magnetically "North" or "South". Because of its magnetic characteristics, if a coil of wire is wrapped around the marking platen in the recessed section 410 of the platen component, the marking platen becomes the pole of an electromagnet. If the coil is wound around the latitudinal axis of the marking platen, the direction of the current flow through the coil determines the magnetic polarity of the front of the marking platen. The image is a result of a series of ink marks on the media. Mounting holes 430 secure the platen to the printing apparatus. Alignment hole 440 connects with alignment post 445 to ensure orientation of the platen with the roller that is perpendicular. When the marking platen is magnetically charged with the correct polarity, the inked surface of the marking brush is magnetically held and slid across the surface of the media. The ink is wiped off the inked marking brush surface and onto the media.

Figure 7:
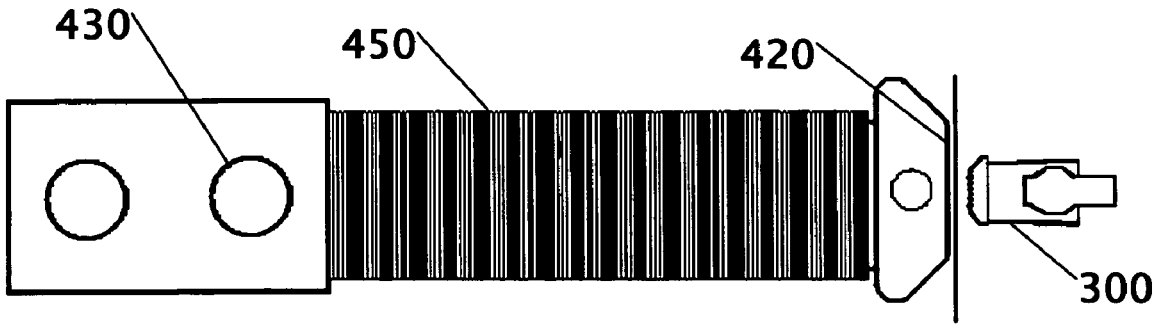
FIG. 7 is a side view of a platen and marking brush shown in the coil repelling position.
Figure 8:
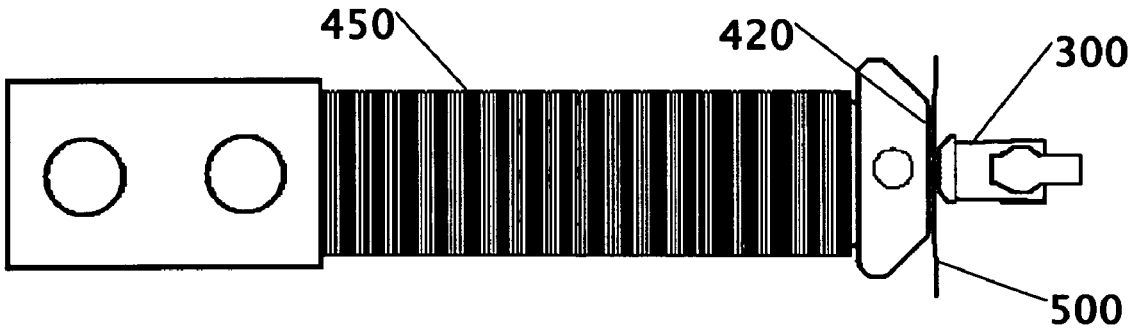
FIG. 8 is a side view of a platen and marking brush shown in the coil attract position.

FIGS. 7 and 8 are side views of a marking brush shown in the coil 450 repelling and attract positions respectively, and how they effect by the direction of coil current. By keeping the current level below that at which the magnetic charge becomes permanent, the magnetic polarity of the marking platen 420 can be freely alternated. A positive current flow (FIG. 8) causes the marking brush 300 to be attracted toward the marking platen 420 and thus it makes contact with the media 500. This results in a mark being made onto the media. A negative current flow causes the marking brush 300 to be repelled away (FIG. 7) from the marking platen and thus there is no mark made onto the media. Mounting holes 430 secure the platen to the printing machine. One marking platen is used for each set of marking brushes. A similar arrangement of coils is incorporated into the ink marking and cleaning stations to attract and mark the media or clean the marking brushes.

The effect of centripetal force from the rotation of the roller is a consideration of the design. This is the force acting upon the outside surface of the marking hammer. This force tends to throw outward any fluid on the surface of the marking hammer. This would lead to uncontrolled marking of the media and tend to get ink on undesired areas of the marking system. The Thor printer design incorporates two primary factors to minimize the effect of the centripetal force. The first factor is the kind of ink used that has a viscous and semi adhesive base. This tends to "stick" to the marking brush. The second factor is the base of the ink that contains ferrite flakes. The marking brush is a magnetic structure, and these ferrite flakes tend to be magnetically attracted to the surface of the marking brush. The two factors tend to make the amount of energy required to "throw-off" the ink very high. Generally, at the rotating speed of the marking roller, the level of centripetal energy is not achieved.

Figure 9:
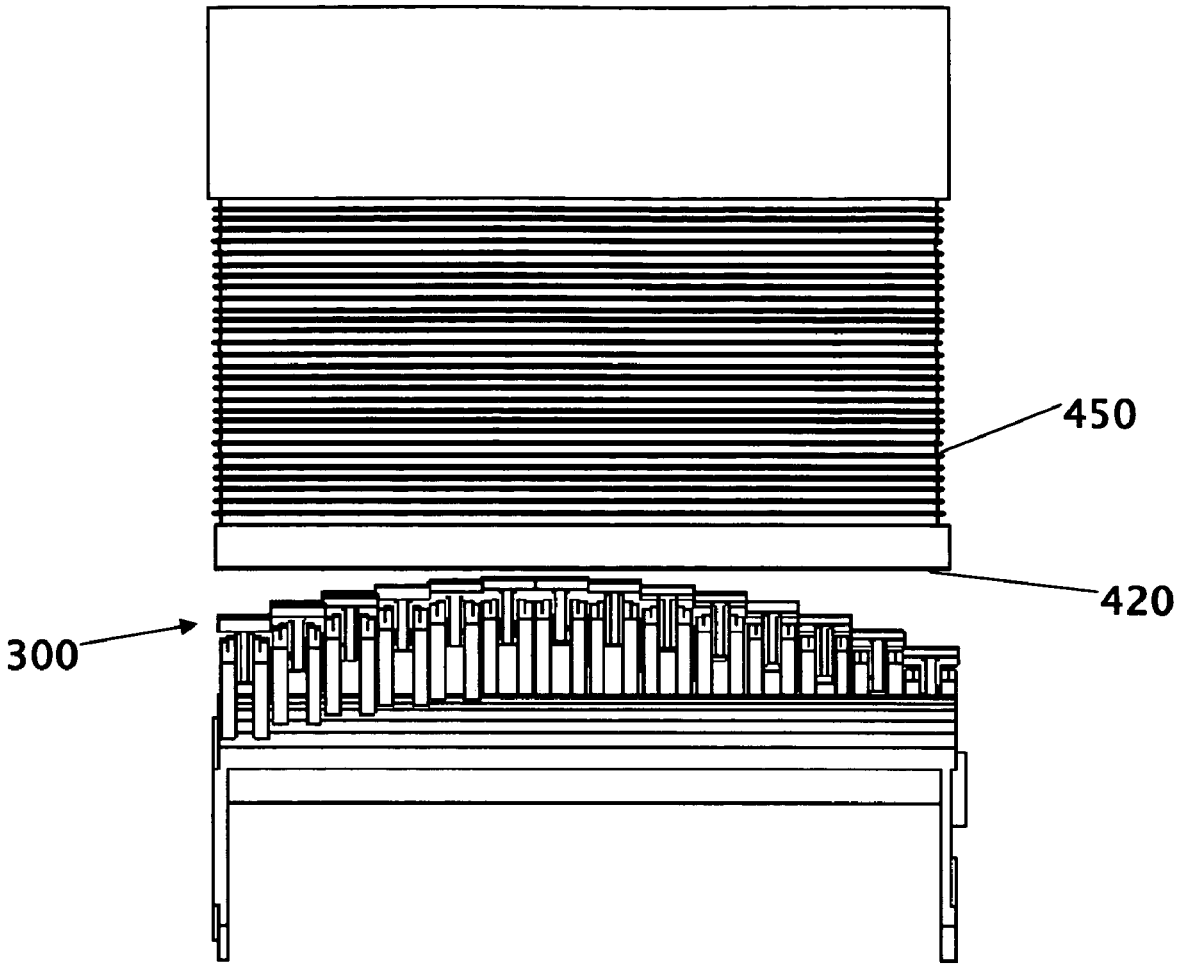
FIG. 9 is a side view of the marking brushes as they engage the platen.

FIG. 9 show a side view of marking brushes 300 as they engage the platen. As the brush mount orbits its own horizontal center, the marking brushes 300, held within the brush yoke 320 on the printing roller 100, move sequentially past the face of the marking platen 420. By electronically synchronizing the polarity of the coil on the marking platen 450 with the presence of any particular marking brush, the brush is attracted to or repelled from the marking platen during its passing time.

As the marking roller rotates, the marking brushes travel along its circumference. At one point, the marking brush pass the marking platen mounted perpendicular to the marking roller. The marking brush will also pass any other object similarly mounted along the circumference. This mechanism has several components such as the marking brushes, marking and inking platens, rotating marking brush mounts and a motorized assembly to rotate the marking brush mounts. The unique arrangement of these components produces a medium resolution economical and rapid printing device. As the brush mount orbits its arc centerline, the brush mounting yoke sequentially and individually cross the reference marking line. If the brush mounts are end-to-end connected into a complete ring, this sequential and individual crossing of the brush yokes is repeated for however many brush mounts per the assembled ring. If the number of brush mounts is the same as number of brush yokes per mount, then for one orbit of the brush mounts, there is an equal amount of brush mount yokes scans across the marking line. If there are marking brushes mounted into each yoke, then there is a corresponding scan of marking brushes. If media travels tangent to the diameter of the ring assembly, at the marking line, then the media can be struck by the scanning marking brushes. If the media is advanced along its travel path, a finite distance each time a brush mount segment passes the marking line, the markings will appear as an X-Y pattern on the media. The content of the array can range from all white (no marks present), to all black (all marks present), to all gray (an even number of equal spaced marks and spaces).

Figure 10:
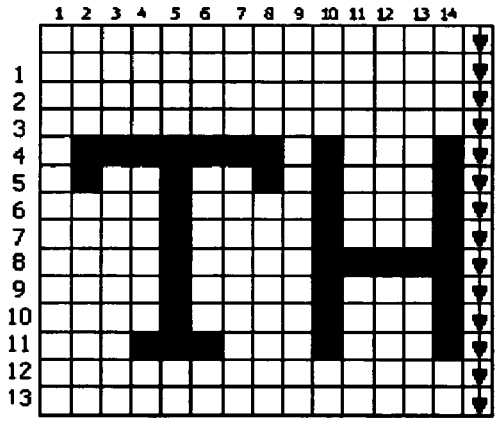
FIG. 10 is a sample of the print that is possible with the printer.

The media travel is tangent to the marking ring between the marking ring and the marking platen. As each brush passes, there is an opportunity to mark the media. When the "space" passes the marking platen there is an opportunity to move the media. It is the controlled use of these "mark" and "move" opportunities that allow the different images to be created. If the media is moved a finite distance each time a space passes, the resulting marking pattern would be shown in FIG. 10.

Figure 11:
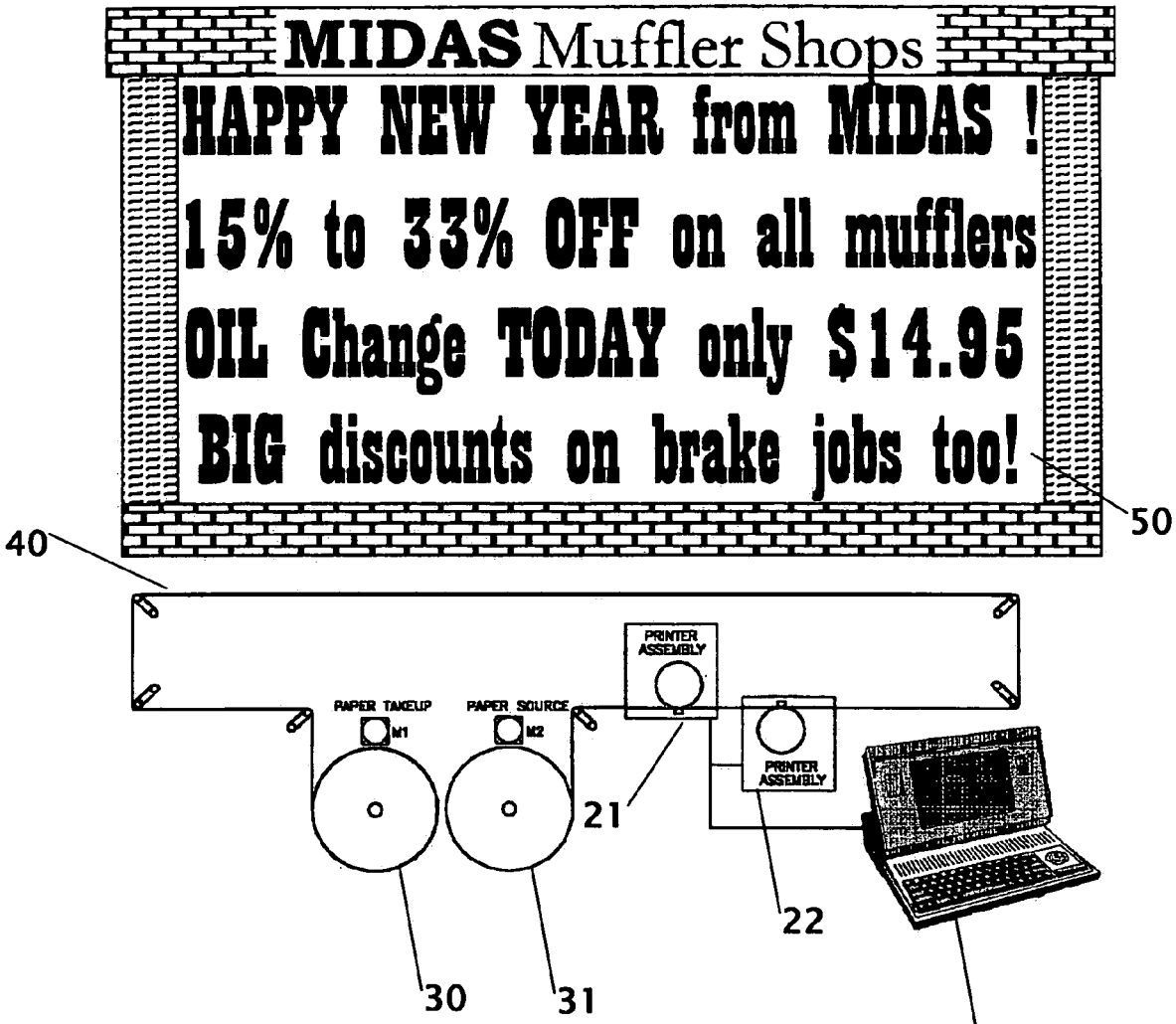
FIG. 11 shows the complete printer in an embodiment of printing a two-sided advertisement sign.

FIG. 11 shows a complete printer in an embodiment of printing a two-sided advertisement sign. This sign can exist as a billboard that can be located on the side of a street, on the bed of a truck or on the side of a road where it is 12 feet high by 28 feet wide. This figure has a computer 30 connected to two separate printers 21 and 22 where each prints on opposite side of the media. A supply reel 31 supplies paper that is printed and then collected on take-up reel 30. This configuration allows the sign 40 to have an image that can be viewed from either side of the media. In this configuration a sign 50 is shown how it may be displayed at a business.

Thus specific embodiments and applications for an expandable Thor ring printer has been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. An expandable printer comprising:

a roller marking ring with multiple marking heads configured in a spiral manner around the roller marking ring, at least one ink blotting station with an electromagnetic coil placed outside the roller marking ring for providing ink to the marking heads, at least one electromagnetic marking platen for attracting the marking heads to the electromagnetic marking platen wherein at least a portion of the ink on the marking heads is transferred to the media that is fed through the printer.

2. The expandable printer from claim 1 wherein the roller marking ring is configured with 14 segments that when connected form a ring.

3. The roller marking ring from claim 2 wherein when multiple rings are stacked they form a cylindrical configuration.

4. The expandable printer from claim 1 wherein the spiral mounted marking heads can each collect and deposit ink onto the paper.

5. The expandable printer from claim 1 wherein the marking heads include a registration indicator to designate the beginning of each spiral pattern of marking heads.

6. The expandable printer from claim 1 wherein the ink blotting station can apply ink to multiple marking heads.

7. The expandable printer from claim 1 wherein each ink blotting station is configured with a different color of ink.

8. The expandable printer from claim 1 wherein four or more ink blotting stations are used consisting of primary colors and black.

9. The expandable printer from claim 1 wherein the electromagnetic coil attracts or repels the marking heads to apply ink to the marking head.

10. The expandable printer from claim 1 wherein the electromagnetic marking platen attracts or repels the marking heads to apply ink to the media.

11. The expandable printer from claim 1 where multiple marking rings, ink blotting stations and electromagnetic marking platens can be stacked or un-stacked to print on various widths of media.

12. The expandable printer from claim 1 wherein the media consists of paper, vinyl, cloth, plastic, or other flexible media that can be printed upon.

13. The expandable printer from claim 1 further includes an interface for communication to a controller for control of the information to be printed.

14. The expandable printer from claim 1 where printers can be placed on opposite sides of the media and the media can be printed on both sides.

15. The expandable printer from claim 1 that further includes a feeding mechanism to transport the media past the marking heads.

16. The expandable printer from claim 15 that further includes a take-up real to collect printed media that has been printed.

17. The expandable printer from claim 1 that further includes at least one ink blotting station to remove excess ink that may be present in the marking heads.

18. A printer that operates by incrementally rotating a roller with multiple marking heads past at least one inking station where the marking heads collect ink and then the roller is further incrementally rotated over a platen where the ink on the marking heads is transferred to media.

19. The printer from claim 18 wherein multiple cylinders can be connected to print onto media of different widths.

20. The printer from claim 18 wherein an application of the ink or the transfer of the ink is from electromagnetic attraction of the marking heads.

* * * * *